United States Patent [19]

Durant et al.

[11] Patent Number: 4,708,049

[45] Date of Patent: Nov. 24, 1987

[54] AUTOMATIC FIRE ARM WITH EXTERNAL MOTOR

[75] Inventors: Jacques Durant, Bourges; Georges Simon, Saint-Germain Du Puy; Alain Charton, Bourges, all of France

[73] Assignee: Etat Francais, France

[21] Appl. No.: 855,159

[22] Filed: Mar. 25, 1986

[30] Foreign Application Priority Data

Mar. 26, 1985 [FR] France ..... 85 04450

[51] Int. Cl.[4] ..... F41D 3/06; F41D 10/28; F41D 10/06

[52] U.S. Cl. ..... 89/11; 89/1.41; 89/33.17; 89/33.25

[58] Field of Search ..... 89/11, 9, 1.41, 33.16, 89/33.17, 33.25

[56] References Cited

U.S. PATENT DOCUMENTS 3,868,884 3/1975 Rose et al. ..... 89/11
4,164,890 8/1979 Elmore et al. ..... 89/11 X
4,167,888 9/1979 Pechamat et al. ..... 89/11
4,397,216 8/1983 Tassie ..... 89/33.25
4,434,699 3/1984 Tassie ..... 89/33.25 X

*Primary Examiner*—David H. Brown
*Attorney, Agent, or Firm*—Parkhurst & Oliff

[57] ABSTRACT

The invention is directed to an automatic firearm apparatus of the type including a feed system and a rotatable drum driven in rotation by an outer motor, wherein the drum includes a closed contour breech drive ramp. The apparatus includes two follower members cooperating with the ramp, each rigidly mounted on a breech to impart to the breech a reciprocating movement between a feed position, in which it is separate from its respective cartridge chamber, and a firing position, in which it closes the cartridge chamber. The feed system includes a feed mechanism rotating continuously and two distribution mechanisms rotating intermittently. Each of the distribution mechanisms are arranged to receive ammunition from the feed mechanism when stopped and, when rotating thereafter, to supply this ammunition to its respective breech while the latter is in its feed position.

5 Claims, 22 Drawing Figures

AUTOMATIC FIRE ARM WITH EXTERNAL MOTOR

This invention concerns an automatic firearm and more particularly, a firearm of the type including a feed system and a rotatable drum driven in rotation by an external motor, wherein the drum includes a breech drive ramp with a closed contour.

Such a firearm is disclosed in U.S. Pat. No. 4,167,888. This firearm includes a breech integral with a follower member cooperating with the drive ramp to cause a reciprocating movement of the breech when the drum is driven in rotation. From an aft position in which ammunition is supplied by the feed system, the breech moves forward loaded with the ammunition that it engages in the barrel cartridge chamber. In the forward position, the breech closes the cartridge chamber and the ammunition is fired. The breech then recoils to its aft position.

Although this weapon operates satisfactorily, the rate of fire is limited. To increase it, it would be necessary to proportionally increase the rotation speed of the rotatable drum, which would raise problems concerning both the power of the outer motor and the mechanical strength of the moving parts.

This invention is aimed at overcoming this drawback by supplying an automatic firearm with an outer motor whose rate of fire is increased with respect to that of the above-mentioned patent, while restricting to a minimum the increase in weight and power consumption.

For this purpose, the invention relates to an automatic firearm of the type including a feed system and a rotatable drum driven in rotation by an outer motor, wherein the drum includes a breech drive ramp with a closed contour. It also includes two follower members cooperating with the ramp, each rigidly fastened to a breech to impress on this breech a reciprocating movement between a feed position in which it is separate from the cartridge chamber and a firing position in which it closes the cartridge chamber. The feed system includes a feed mechanism with a continuous rotational movement and two distribution mechanisms with intermittent rotational movements, each of the distribution mechanisms being arranged to receive, while it is stopped, an ammunition from the feed mechanism and to supply, while it is rotating, this ammunition to its respective breech while it is in its feed position.

The weapon according to the invention therefore includes two barrels and two moving breeches. Each of the breeches is driven by a follower member and both follower members cooperate with the same drive ramp. This weapon therefore includes a single outer motor and a single rotatable drum. As the weight of each of the breeches is relatively small, the same outer motor can be used to drive two breeches at practically the same speed as it would drive a single one. However, owing to the presence of the two barrels, the rate of fire is nearly double for a minimal increase in weight.

Preferably, the ramp includes two segments perpendicular to the drum axis, respectively next to and away from the cartridge chamber and two helicoidal segments inclined with respect to the drum axis, such that the makes four revolutions around the drum, i.e., crossing over itself three times and the follower members are held in the same diametral plane of the drum, each on one side of the axis.

The particular form of the ramp is already known under U.S. Pat. No. 4,167,888.

This form however has a particular advantage in this invention, in which the two follower members are arranged in the same diametral plane of the drum.

As will be seen below, in this case, the respective stopping and starting of the two breeches in their end positions are offset in time, which means that the rotatable drum is never subjected to the impact which wold arise from simultaneous starting or stopping.

In a particular embodiment of the invention, each distribution mechanism is a transverse star-shaped section, each branch of the star having its leading edge with respect to the direction of movement shaped to drive the ammunition during the period of movement of the mechanism and its trailing edge shaped to guide, in its rest position, the ammunition driven by the other mechanism.

Thus, each distribution mechanism is used both for feed of its breech during its periods of movement and for guidance of the ammunition guided towards the other breech during its rest period.

The distribution mechanisms can be driven by any system imparting intermittent movements, such as a Malta cross system.

However, when the distribution mechanisms are stars with three branches, they are preferably driven by an intermittent driven Fergusson system with one cam and two cages, the cam being driven continuously by the outer motor and each of the cages intermittently driving the distribution mechanisms.

A particular embodiment of the invention will be described below as an unrestrictive example with reference to the accompanying drawings.

Figure 1:
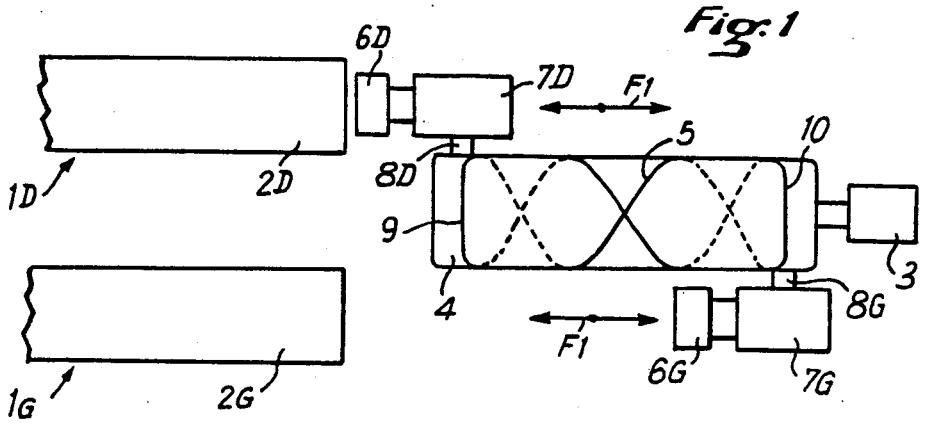
FIG. 1 is a schematic view of a weapon in accordance with the invention.
Figure 2:
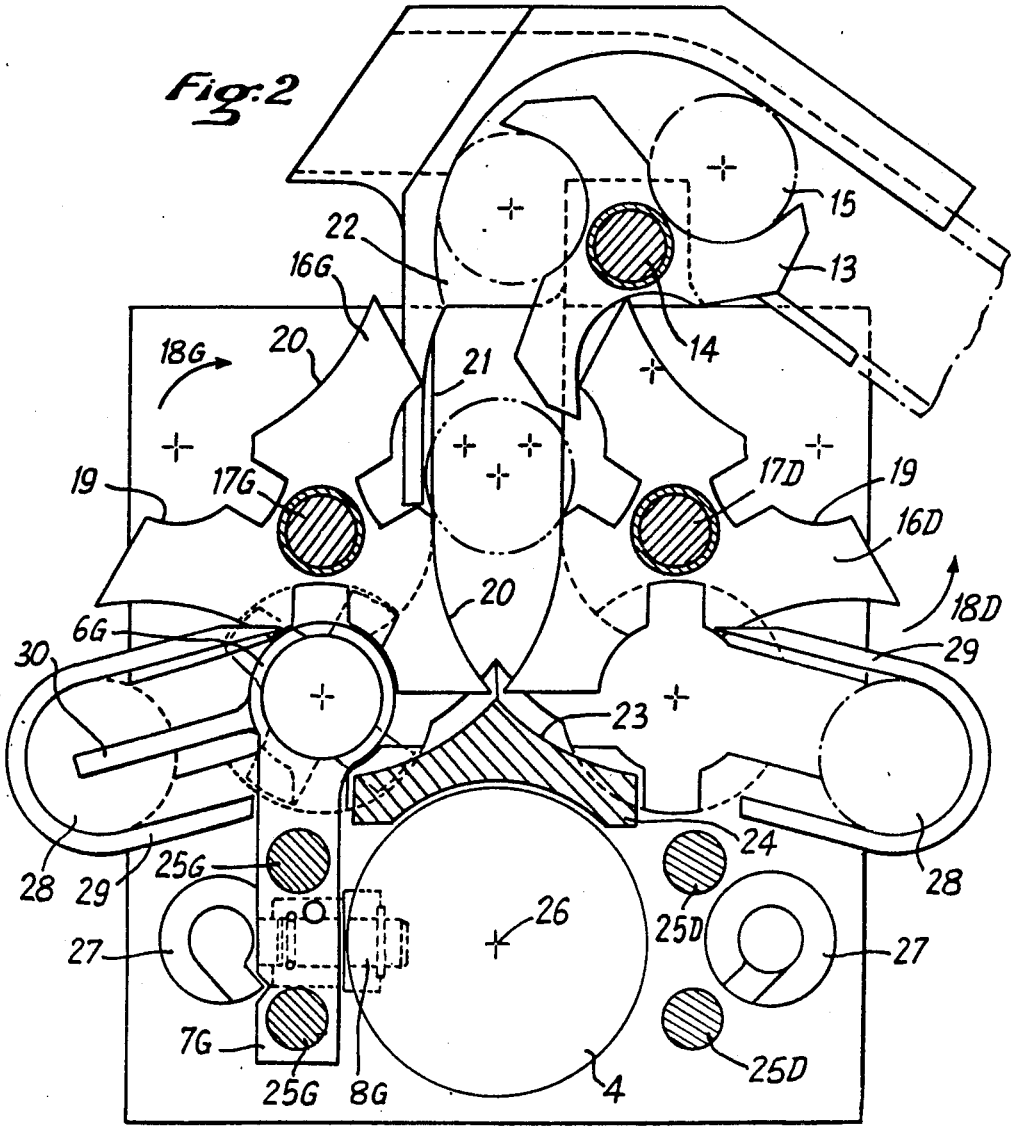
FIG. 2 is a cross section perpendicular to the rotatable drum.

FIGS. 5*a* to 5*i* schematically represent operation of the system illustated in FIG. 2; and FIGS. 6*a* to 6*i* schematically represent operation of the system illustrated in FIG. 1.

The firearm represented in FIG. 1 includes two barrels 1G (LH) and 1D (RH), each with a cartridge chamber schematically represented as 2G and 2D.

Motor 3 drives in rotation drum 4 with drive ramp 5 which will be described in greater detail below.

Breeches 6G and 6D are associated with cartridge chambers 2G and 2D and are carried by breech casings 7G and 7D, respectively.

Follower members 8G and 8D are mounted on breech casings 7G and 7D and cooperate with ramp 5 to cause alternating movement of breeches 6G and 6D in the direction of arrows F1.

Figure 4:
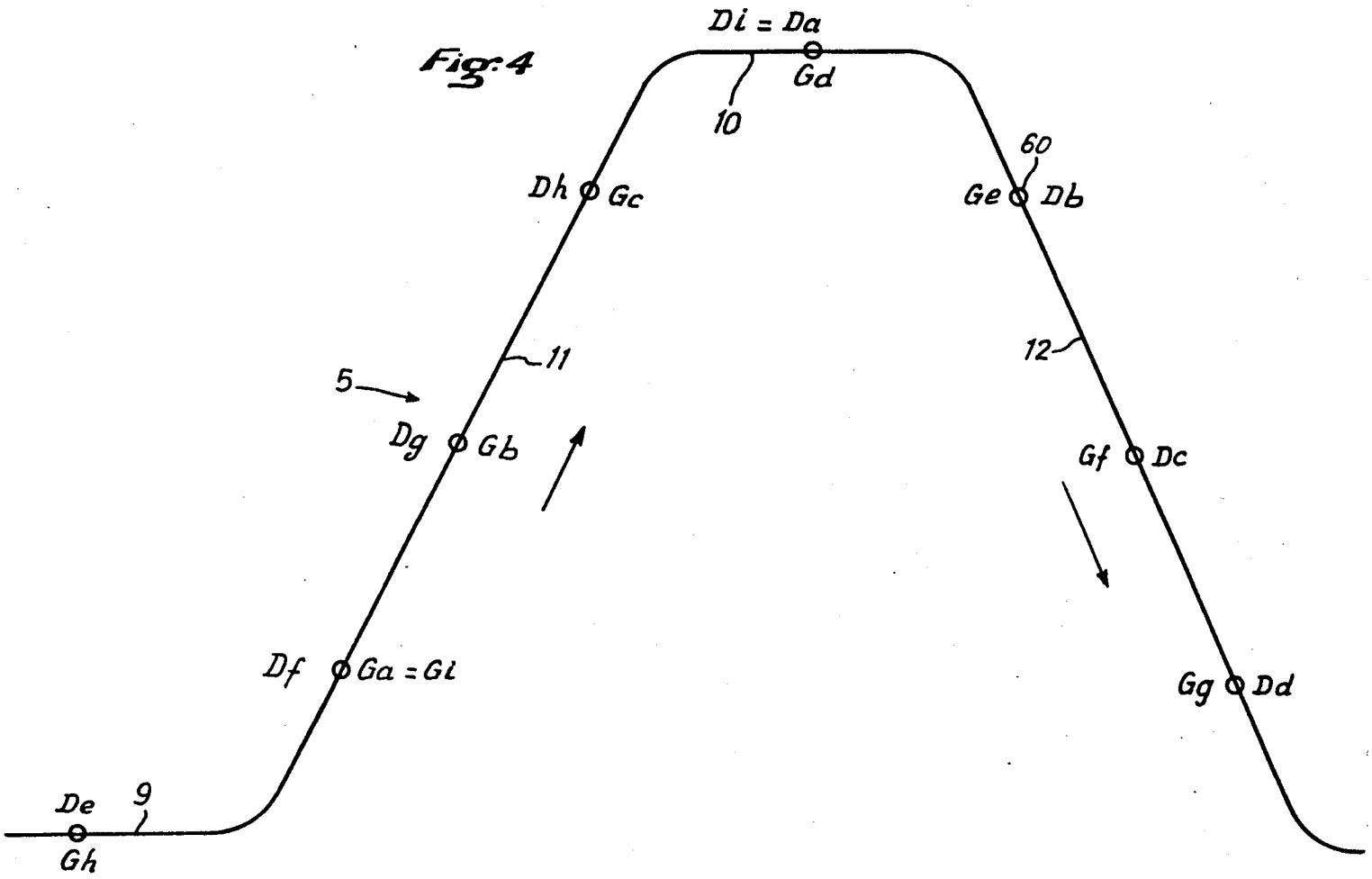
FIG. 4 is a developed view of the drive ramp.

FIG. 4 represents ramp 5 developed.

This ramp, when developed, includes two straight segments 9 and 10 which, on drum 4, are accordingly located in straight section planes.

These parts 9 and 10 are connected by parts 11 and 12 inclined at a constant angle with respect to the axis of drum 4.

The ramp of FIG. 4 making four revolutions around drum 4, i.e. crossing over itself three times.

Breeches 6G and 6D are therefore immobile when their respective follower members 8G and 8D are located in either segment 9 or segment 10 of ramp 5.

When the follower member of one of the breeches is located in segment 9 of the ramp, the respective breech is in its forward position, i.e. its firing position where it closes cartridge chamber 2. When the follower member is located in segment 10 of the ramp, the breech is in is aftmost position with respect to the cartridge chamber, i.e. as will be seen below, in its feed position.

FIG. 2 shows feed mechanism 13, mounted rotatably around shaft 14 to drive ammunition belt 15 and feed the ammunition, after extracting it, to star-shaped distribution mechanisms 16G and 16D.

Each of the stars 16G and 16D is a star with three branches rotating around shafts 17G and 17D respectively in the direction of arrows 18G and 18D. The leading edge 19 of each of the branches with respect to the direction of rotation of the distribution stars has a circular section with substantially the same radius as ammunition 15 so as to drive the ammunition by rotation of the star. Trailing edge 20 forms a guide profile connecting, when the distribution star is stopped, with guide profile 21 of feed tube 22 and guide profile 23 of fixed part 24. Therefore, when an ammunition is driven by a profile 19 of a given distribution star during rotation of the star, it is simultaneously guided by a profile 20 of the other distribution star which is then stopped.

The means of driving one of the stars in rotation while the other is stopped will be described below.

FIG. 2 also shows lefthand breech 6G mounted on breech mechanism head 7G on which is rigidly mounted follower member 8G engaged in the drive ramp of rotatable drum 4.

In order to guide the breech mechanism head, this head is mounted on fixed rails 25G.

The righthand breech is not shown but it can however be seen that it is guided by rails 25D in a plane symmetrical to the plane of breech 6 with respect to the axis of rotation 26 of drum 4. Thus, the follower members integral with the two breeches are located 180° from one another in ramp 5.

FIG. 2 also shows blocking systems 27 assuring safety in case of hang fire. These blocking systems are not described in further detail as they are already known.

Finally, FIG. 2 shows the ejection spider 28 for the shells of the ammunitions just fired. The shells are brought to each of the spider channels pushed by leading edge 19 of the respective feed star and guided by rails 29.

The shells are then ejected by channels 28 by means of pushrods 30 rigidly mounted on each of breeches 6.

The drive systems of the mechanisms of FIG. 2 are now described with reference to FIG. 3.

This figure shows shaft 26 of drum 4 which, as was described above, is driven by outer motor 3. Pinion 31 is mounted on shaft 26 and meshes with pinion 32 mounted on shaft 33 on which is mounted a second pinion 34.

Pinion 34 meshes with pinion 35 mounted on shaft 36, on which is also mounted double cam 37 of a Fergusson system of known type. This double cam 37 cooperates with two cages 38G and 38D each fitted in a known way with six fingers 39 meshing with lobes 40 on double cam 37. Thus, for each revolution of double cam 37, each cage 38 makes one-third of a revolution during passage of lobes 40.

Cage 38 is mounted on shaft 17D of feed star 16D whereas cage 38G is mounted on shaft 41 forming an angle with shafts 36 and 17D so as to synchronize rotation of distribution stars 16G and 16D.

On shaft 41 is also mounted pinion 42 meshing with pinion 43 mounted on shaft 17D of distribution star 16D.

Finally, pinion 44 is mounted on shaft 14 of feed mechanism 13 and meshes with pinion 35 such that a continuous rotation is imparted to feed mechanism 13.

Figure 3:
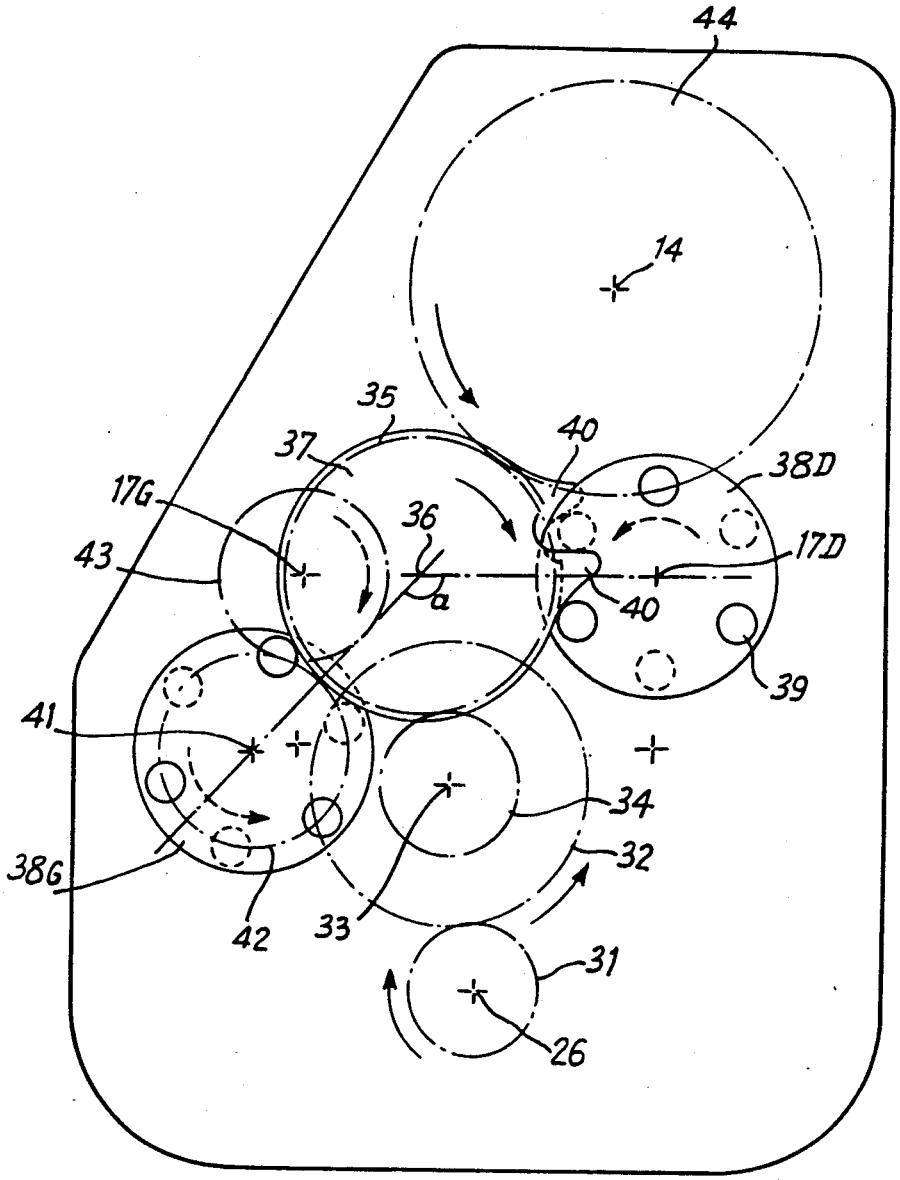
FIG. 3 is a view, in a plane parallel to that of FIG. 2, of the drive mechanism.

The arrows of FIG. 3 show the directions of rotation of the various shafts. The solid arrows represent a continuous movement and the broken arrows a discontinuous movement.

Pinions 31 and 34 have the same number of teeth as do pinions 32 and 35 and pinions 42 and 43. Finally, angle a between shafts 17D and 41 with respect to shaft 36 is 135°.

Thus the intermittent movements of the two stars 16G and 16D are suitably synchronized and in opposite directions.

FIGS. 5*a* to 5*d* represent the various phases of operation of the feed system.

Figure 5A:
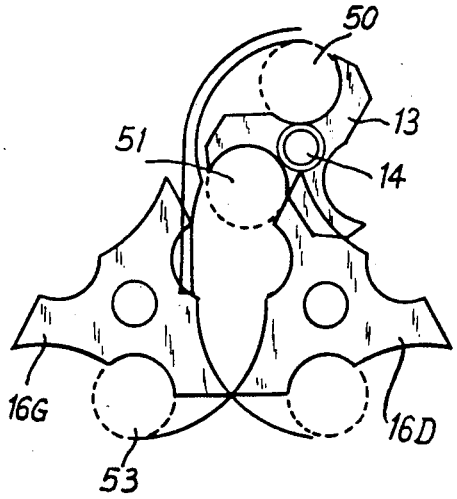
Figure 5B:
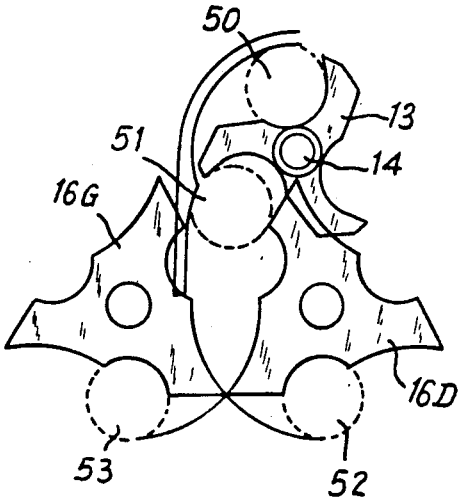
Figure 5C:
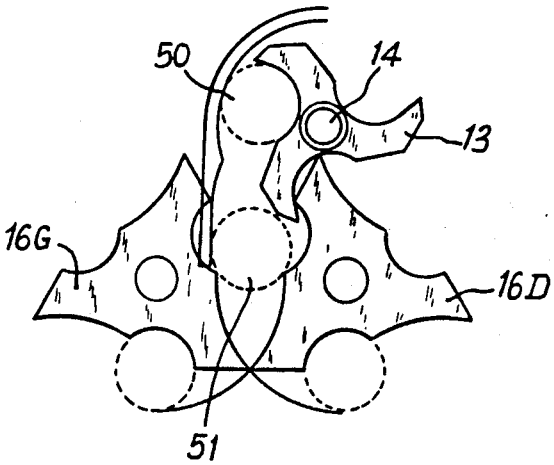

In FIGS. 5*a* to 5*c*, distribution stars 16G and 16D are immobile and only feed mechanism 13 rotates around shaft 14, simultaneously driving two ammunitions, 50 and 51. During the phases represented in FIGS. 5*a* to 5*c*, ammunition 50 is extracted while ammunition 51 is brought between stars 16G and 16D. It is also during this period that ammunition 52 is fired in the righthand barrel.

Figure 5D:
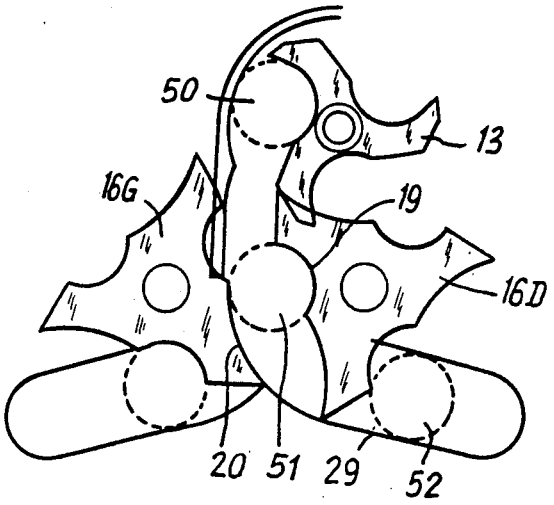
Figure 5E:
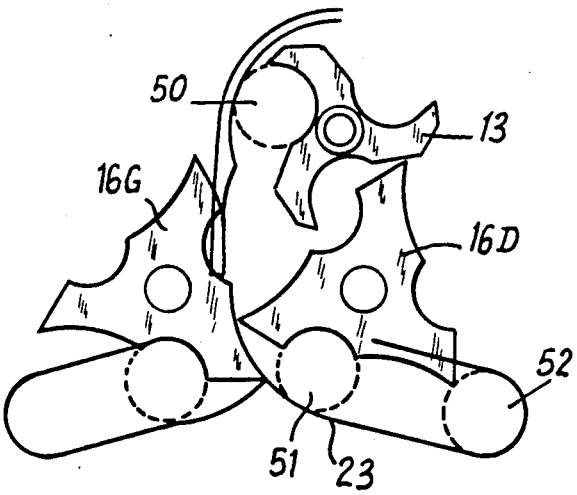
Figure 5F:
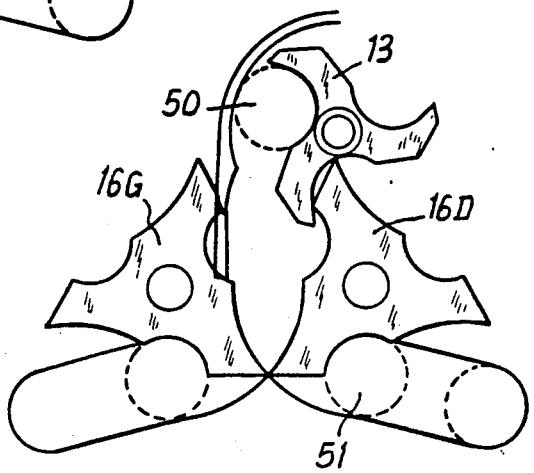

FIGS. 5*d* to 5*f* represent the rotation of the righthand distribution star 16D. During this rotation, the lefthand distribution star 16G remains immobile. Feed mechanism 13 continues of course to rotate, but since star 16 is rotating very fast, the movement of mechanism 13 is not visible in FIG. 5*d* to 5*f*.

As can be seen in FIG. 5*d*, ammuniton 51 is driven by one of the leading edges 19 of star 16D and guided by one of the trailing edges 20 of star 16G. The movement continues on FIG. 5*e* where ammunition 51 is then guided by profile 23 of mechanism 24.

Simultaneously, ammunition 52 is pushed between guides 29 by one of the edges of star 16D up to its ejection position of FIG. 5*e*.

In the position of FIG. 5*f*, star 16D has made one-third of a revolution and is again stopped.

As feed mechanism 13 continues to rotate, the cycle returns to the phases of FIG. 5*a* to 5*c* described above, in which ammunition 50 is brought between stars 16G and 16D and ammunition 53 is fired in the lefthand barrel.

Figure 5G:
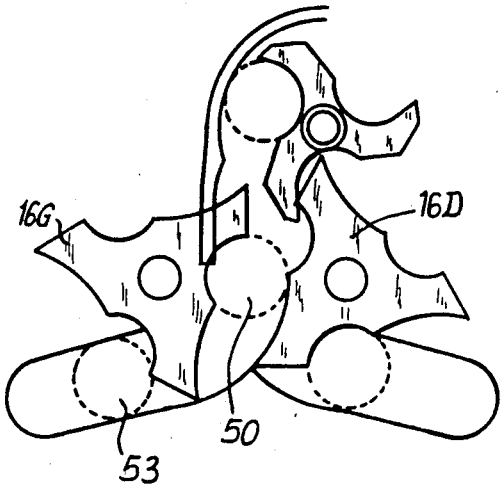
Figure 5H:
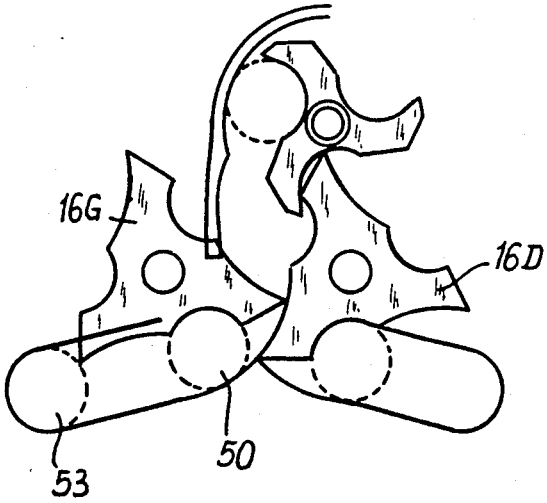
Figure 5I:
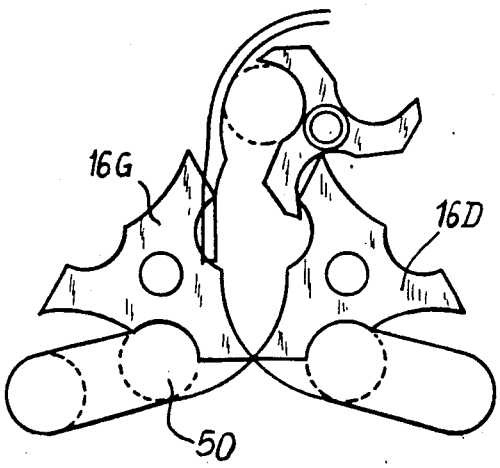

Lefthand distribution star 16G then starts to move as shown in FIGS. 5*g* to 5*i*, while distribution star 16D remains immobile.

The phases shown in FIGS. 5*g* to 5*i* are similar to those of FIGS. 5*d* to 5*f*; ammunition 50 is brought to the lefthand breech and ammunition 53 is brought to ejection position.

The cycle is then repeated from FIG. 5*a*.

The movement of the breeches is described below with reference to FIGS. 4 and 6*a* to 6*i*.

A number of points of ramp 5 are shown in FIG. 4. For each of these points is indicated the FIG. 6 containing the LH (G) and RH (D) breeches for this point. For instance, FIG. 6*e* shows the LH breech going through point 60 and FIG. 6*b* shows the RH breech going through this same point 60.

Figure 6A:
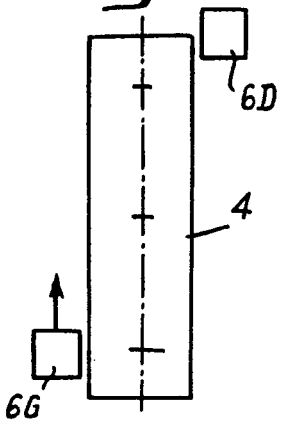
Figure 6B:
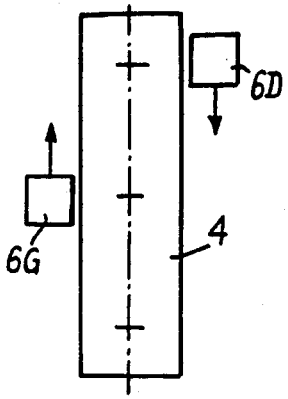
Figure 6C:
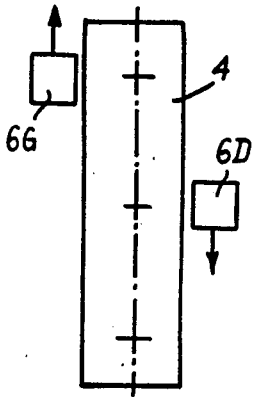

FIG. 6*a* shows the RH breech stopped in the aft feed position, i.e. with its follower member in segment 10 of control ramp 5. At the same time, the LH breech begins to recoil with its follower member at the start of segment 11 of the ramp.

Figure 6D:
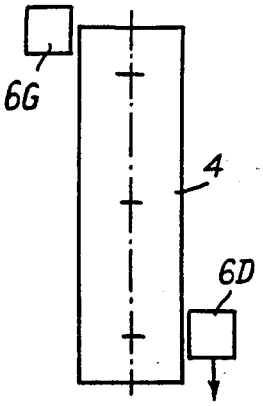

The RH breech then start moving forward (FIG. 6*b*) and this movement continues while the LH breech continues to recoil (FIG. 6*c*) then stops in aft feed position (FIG. 6*d*).

Figure 6E:
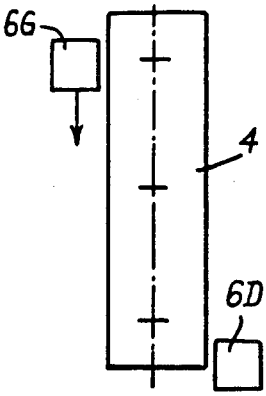
Figure 6F:
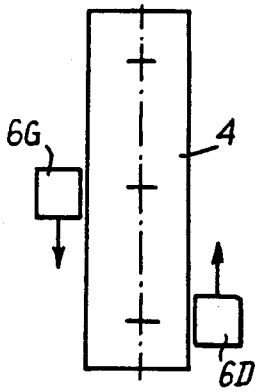
Figure 6G:
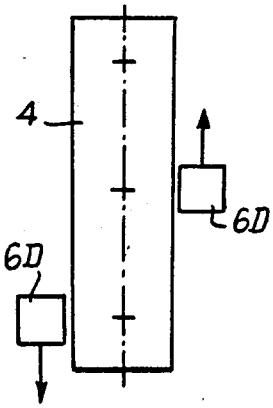

The RH breech then stops in forward position and the LH breech begins to move forward (FIG. 6*e*). The ammunition in the RH cartridge chamber is fired during this phase.

The RH breech then starts to recoil (FIG. 6*f*) and continues this movement (FIG. 5*g*) while the LH breech continues to move forward.

Figure 6H:
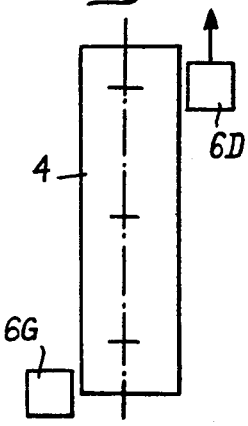

In FIG. 6*h*, the RH breech ends its recoil movement whereas the LH breech is stopped in forward position and the ammunition contained in the LH cartridge chamber is fired.

Figure 6I:
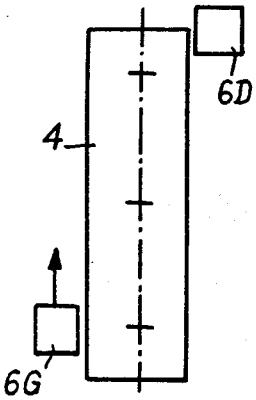

Finally, FIG. 6*i* is identical to FIG. 6*a*, as the RH and LH breeches have returned to their initial positions.

It should be noted that because ramp 5 makes four revolutions around itself and because follower members 8G and 8D are diametrically opposite with respect to axis 26 of drum 4, the breech movements are not symmetrical, with the result that stopping and starting of the breeches are offset in time which limits the peak power required of outer motor 3.

This also explains the fact that in FIG. 3, shafts 17D and 41 of cages 38D and 38G are not diametrically opposite with respect to shaft 36 of double cam 37.

Various alternates and modifications can of course be made to the above description without departing from the framework or spirit of the invention.

We claim:

1. An automatic firearm of a type including a feed system, comprising:

a rotatable drum driven in rotation by an outer motor, said drum including a closed contour breech drive ramp;

first and second follower members cooperating with said ramp, each said follower member being rigidly mounted to a breech associated with a cartridge chamber to impart to each said breech a reciprocating movement between a feed position where it is separated from its respective cartridge chamber and a firing position where it closes said respective cartridge chamber;

feed means, including continuously rotating dispensing means and distribution means, said distribution means respectively including first and second intermittently rotating means respectively associated with said breeches;

whereby said first and second intermittently rotating means cooperate with said follower members, said rotatable drum and said dispensing means, such that ammunition is dispensed from said dispensing means to said intermittently rotating means when said intermittently rotating means are not rotating, and said ammunition is supplied from said intermittently rotating means to their respective breeches when said respective intermittently rotating means are rotating.

2. An automatic firearm according to claim 1, wherein said ramp includes two segments perpendicular to the axis of the drum, respectively adjacent to and remote from the cartridge chamber, and two helicoidal segments inclined with respect to the drum axis, said ramp being wrapped around said drum such that it crosses itself three times; and said follower members being held in the same diametral plane of the drum, each on one side of the axis.

3. An automatic firearm according to claim 1, wherein said intermittently rotating means are driven by an intermittent drive Fergusson system, sidd intermittent drive system including one cam and two cages, the cam being continuously driven by the outer motor and each of the cages intermittently driving one of said intermittently rotating means.

4. An automatic firearm according to claim 1, wherein each said intermittently rotating means has a transverse starshaped section, each branch of each said star having a leading edge with respect to the direction of rotation shaped to drive the ammunition during periods of rotation of said intermittently rotating means, and a trailing edge shaped to guide, during its idle period, the ammunition driven by the other said intermittently rotating means.

5. An automatic firearm according to claim 4, wherein said star is a three-branch star.

* * * * *